US005406300A

United States Patent [19]

Tokimoto et al.

[11] Patent Number: 5,406,300

[45] Date of Patent: Apr. 11, 1995

[54] SWING TYPE AERIAL DISPLAY SYSTEM

[75] Inventors: Toyotaro Tokimoto, Yokohama; Hiroshi Yajima, Zushi, both of Japan

[73] Assignee: AVIX, Inc., Zushi, Japan

[21] Appl. No.: 991,547

[22] Filed: Dec. 11, 1992

[30] Foreign Application Priority Data

Dec. 12, 1991 [JP] Japan ..... 3-109883 U

[51] Int. Cl.[6] ..... G09G 3/20

[52] U.S. Cl. ..... 345/31; 345/39

[58] Field of Search ..... 340/755, 815.45, 815.53; 73/493, 517 R; 200/61.45 M, 61.53; 250/221, 229; 362/806, 811; 315/323; 273/186.2; 345/31, 39

[56] References Cited

U.S. PATENT DOCUMENTS

| | | | |
|---|---|---|---|
| 3,737,722 | 6/1973 | Scharlack . | |
| 3,737,731 | 6/1973 | Zeewy . | |
| 3,806,131 | 4/1974 | Evans | 273/186.2 |
| 3,846,784 | 11/1974 | Sinclair | 345/31 |
| 3,893,149 | 7/1975 | Grenon . | |
| 3,945,646 | 3/1976 | Hammond | 73/493 |
| 3,984,674 | 10/1976 | Guetta . | |
| 3,986,144 | 10/1976 | Russo . | |
| 4,161,018 | 7/1979 | Briggs et al. . | |
| 4,264,845 | 4/1981 | Bednarz . | |
| 4,308,572 | 12/1981 | Davidson et al. . | |
| 4,338,547 | 7/1982 | McCaslin . | |
| 4,462,044 | 7/1984 | Thomason et al. | 345/31 |
| 4,470,044 | 9/1984 | Bell | 345/31 |
| 4,602,191 | 7/1986 | Davila . | |
| 4,782,336 | 11/1988 | Bailey . | |
| 5,027,112 | 6/1991 | Ross et al. . | |
| 5,036,442 | 7/1991 | Brown . | |
| 5,057,827 | 10/1991 | Nobile et al. | 345/31 |
| 5,079,679 | 1/1992 | Chin-Fa . | |
| 5,081,568 | 1/1992 | Dong et al. . | |
| 5,121,146 | 6/1992 | Smith et al. . | |
| 5,148,310 | 9/1952 | Batchko . | |
| 5,194,706 | 3/1993 | Reneau | 200/61.45 M |

FOREIGN PATENT DOCUMENTS 2247802 3/1992 United Kingdom .

OTHER PUBLICATIONS

Cook, Stephanie L., "A new police baton communicates with drivers", Japan Times, Jul. 23, 1992, p. 24.

*Primary Examiner*—Richard Hjerpe
*Assistant Examiner*—Vivian Chang

[57] ABSTRACT

A swing type aerial display system is adapted to aerially display a desired visual image utilizing a residual image effect of a moving light emitting array. In order to establish synchronization of the motion of said moving light emitting array and illuminating timing of individual cells in the light emitting array, the motion behavior of the system is monitored and timing to drive each individual cell is controlled in relation to the monitored motion behavior of the light emitting array, so that the desired image becomes visible at a desired position and desired configuration.

37 Claims, 12 Drawing Sheets

SWING TYPE AERIAL DISPLAY SYSTEM

BACKGROUND OF THE INVENTION

1. Field of the Invention

The present invention relates to an aerial display system for aerially displaying a visual image, such as character image, graphic image or so forth with a light emitting moving array. More specifically, the invention relates to an aerial display system for aerially displaying an image with a flashing light emitted from a hand-held member, such as a traffic control stick or so forth.

2. Description of the Related Art

Illuminated sticks are widely used in traffic control. The illuminated sticks are known to be particularly useful in the dark for strong visual impact. It is typical manner of traffic control with such illuminated stick to vary the behavior of the stick between an indication of instructions to stop the traffic (STOP instructions) and an indication of instructions to allow the traffic to pass through (GO instructions). Drivers of automobiles tend to be confused in distinguishing the STOP instructions and GO instructions. Furthermore, in certain circumstances of use of such illuminated sticks, misunderstanding of the instructions may cause traffic accidents.

In view of such a problem with the illuminated stick, there has been proposed an illuminated stick which is capable of displaying a character message using persistence of vision of a motion of an illuminated stick. In general, such stick is provided with a plurality of light emitting elements, such as LEDs, for selectively illuminating selected sets of LEDs at respective timing so that the residual image of the illuminating elements may form a display image in combination. For this purpose, the illumination of respective light emitting elements is controlled cyclically according to a preliminarily programmed illuminating schedule. Therefore, when the stick is moved substantially in synchronism with the cycle of variation of the illuminating set of the light emitting elements, the desired display image becomes visually perceptible.

In the image displaying type illuminated stick, a difficulty is encountered in synchronization of the motion of the stick to the variation cycle of the illuminating set of the light emitting elements. For the reason of substantial difficulty in practical use, this type of the illuminated stick has not been commercially successful.

SUMMARY OF THE INVENTION

Therefore, it is a primary object of the present invention to provide an aerial display system which permits clear aerial display of a desired image, such as character image, graphic image or so forth irrespective of a motion speed of a light emitting array.

Another object of the present invention is to provide an aerial display system which can automatically adjust a cycle frequency of variation of illuminating set of light emitting elements of the light emitting array depending upon motion speed and amplitude thereof.

A further object of the present invention is provide an illumination control system for an aerial display system, which can control timing of illumination of respective individual light emitting elements for synchronization with an arbitrary motion of the light emitting array.

A still further object of the present invention is to provide to an aerial display system suitable for application to a hand-held member, such as an illuminated stick, baton or so forth.

In order to accomplish the above-mentioned and other objects, a swing type display system, according to the present invention, generally comprises:

an elongated hand-held movable body carrying a light emitting cell array including a plurality of light emitting cells arranged in alignment for reciprocally swinging a desired surface, thereby scanning the light emitting cell array thereon and forming a visual image utilizing an effect of residual image;

a display data storage means for storing display data in the form of a bit map;

a display data reading out control means for reading out display data from the display data storage means in a given order at a given speed;

a driver means adapted to the light emitting cell array, for receiving given bits of the display data read out by the display data reading out control means and for driving each of the light emitting cell arrays ON and OFF;

a swing detecting means for detecting the swinging motion of the movable body in a given direction on the basis of an acceleration of the swinging motion of the movable body and for producing a detection signal; and a timing control means for deriving a trigger signal on the basis of the detection signal of the swing detecting means for controlling operation timing of the display data reading out control means and the driver means.

According to the first aspect of the invention, the swing detecting means includes an acceleration sensor generating an output corresponding to an acceleration of the swing motion of the movable body, and a signal processing means for detecting a specific operational point in the swing motion of the movable body by processing the output waveform of the acceleration sensor.

With the construction set forth above, since the acceleration of the substantially reciprocal swing motion of the movable body can be precisely detected by the acceleration sensor, a specific point in the motion stroke can be detected with relatively simple process of the signal processing means of the detection signal. Since the trigger signal is derived on the basis of the output of the signal processing system, synchronization of the swing motion of the movable body and the display control can be appropriately and accurately established.

According to the second aspect of the invention, the swing detecting means includes a movement reciprocally movable within a predetermined range defined by a guide mechanism in response to a substantially reciprocal swing motion of the movable body and a position sensor for detecting the movement passing across a predetermined position set between both ends of the predetermined range in a non-contacting manner.

With the construction set forth above, since the movement shifts from one end to the other end in response to reversal of direction of the acceleration during swing motion of the movable body, the detection signal may be attained from the position sensor at the intermediate position of swing motion of the movable body with high certainty. Since the trigger signal is derived on the basis of the output of the position sensor, synchronization of the swing motion of the movable body and the display control can be appropriately and accurately established.

According to the third aspect of the invention, the swing type display system further includes a display initiation timing adjusting means responsive to substantially reciprocal repeated swing motion of the movable body for controlling the timing control means to adjust a delay period from occurrence of the detection signal of the swing detecting means to initiation of reading out of the display data by the display data reading out control means on the basis of an instantaneous swing speed at a given point in the swing motion and/or repeating period of the swing motion.

In the hand-held swing motion, the swing speed and swing stroke may be variable depending upon the operator. However, on the other hand, it is naturally desirable from the view point of visual recognition of the displayed image to form the image at a substantially fixed position. The third aspect of the present invention achieves this by fixing the display initiating position.

According to the fourth aspect of the invention, the swing type display system further includes a data output speed adjusting means responsive to substantially reciprocal repeated swing motion of the movable body for controlling the timing means to adjust reading out speed of the display data by the display data reading out control means on the basis of an instantaneous swing speed at a given point in the swing motion and/or repeating period of the swing motion.

The fourth aspect of the invention as set forth above achieves the same task as the third aspect by substantially fixing the length of the display image in the swing direction.

According to the fifth aspect of the invention, the swing type display system further includes a display initiation timing adjusting means responsive to substantially reciprocal repeated swing motion of the movable body for controlling the timing control means to adjust a delay period from occurrence of the detection signal of the swing detecting means to initiation of reading out of the display data by the display data reading out control means on the basis of an instantaneous swing speed at a given point in the swing motion and/or repeating period of the swing motion; and a data output speed adjusting means responsive to substantially reciprocal repeated swing motion of the movable body for controlling the timing means to adjust the reading out speed of the display data by the display data reading out control means on the basis of an instantaneous swing speed at a given point in the swing motion and/or repeating period of the swing motion.

The fifth aspect of the invention as set forth above achieves the same task as the third aspect. The display initiation position is fixed and the length of the display image in the swing direction is adjusted.

According to the sixth aspect of the invention, the swing type display system further comprises a swing mode discrimination means for discriminating a current swing mode out of a plurality of preliminarily set swing modes which are set relative to the gravitative direction; and a data selection means for selectively identifying one of a plurality of display data stored in the display data storage means on the basis of the output of the swing mode discrimination means.

There are various methods for switching images to be displayed. For instance, the display data may be updated by writing-in the data through a data write-in means, such as a keyboard. Alternatively, it may be possible to preliminarily store a plurality of display data in the display data storage means and select one of the display data by manual operation of a switch or so forth.

In contrast to the approaches set out above, the sixth aspect of the invention as set forth above is that it is capable of automatic switching of the display image depending upon the swing modes of the movable member. To achieve this, a plurality of swing modes, e.g. left and right swing mode for swinging the movable member in a substantially symmetric fashion relative to the vertical axis parallel to the force of gravity, vertical swing mode for swinging the movable member substantially perpenticular to the direction of the force of gravity, are set relative to the force of gravity. By this, the mutually distinct images can be displayed at different swing modes.

According to another invention, a display system comprises:

a movable member carrying a light emitting cell array formed with a plurality of individual light emitting cells arranged in alignment essentially in perpendicular to the direction of motion of the movable member, the movable member being adapted to move across a desired aerial display area with carrying the light emitting cell array;

a data storage means for storing at least one field of image data defining a display image, the at least one field of image data containing display data for each scanning line corresponding to the instantaneous position of the movable member in motion;

a motion detecting means associated with the movable member for detecting motion of the movable member to produce a detection signal representative of a motion parameter of the movable member; and a control means for receiving the detection signal from the motion detecting means to derive a motion associated control parameter and controlling each of the light emitting cells for illuminating selected one or more light emitting cells corresponding to the display data of each scanning line with shifting the scanning line in order over one field for synchronizing the display timing for respective scanning lines with the motion of the movable member.

BRIEF DESCRIPTION OF THE DRAWINGS

The present invention will be understood more fully from the detailed description given herebelow and from the accompanying drawings of the preferred embodiments of the invention, which, however, should not be taken to be limitative to the invention, but are for explanation and understanding only.

In the drawings:

FIGS. 12(A) and 12(8) are timing charts showing manner of discrimination of modes of motion of the light emitting array.

DESCRIPTION OF THE PREFERRED EMBODIMENT

Discussion will be given hereinafter for an aerial display system according to the present invention. It should be appreciated that while the following discussion is given in terms of application of the preferred embodiment of the aerial display system for an illuminated stick to be used for traffic control or so forth, the aerial display system according to the present invention is suitable for wide variety of applications for aerially displaying character messages, graphic images or so forth with arbitrary motion. It should be noted that while the preferred application of the aerial display system according to the invention is for a hand-held device for aerially displaying a visual image according to manual arbitrary motion, it may be, of course, applicable for machine operated equipment or so forth.

Figure 1:
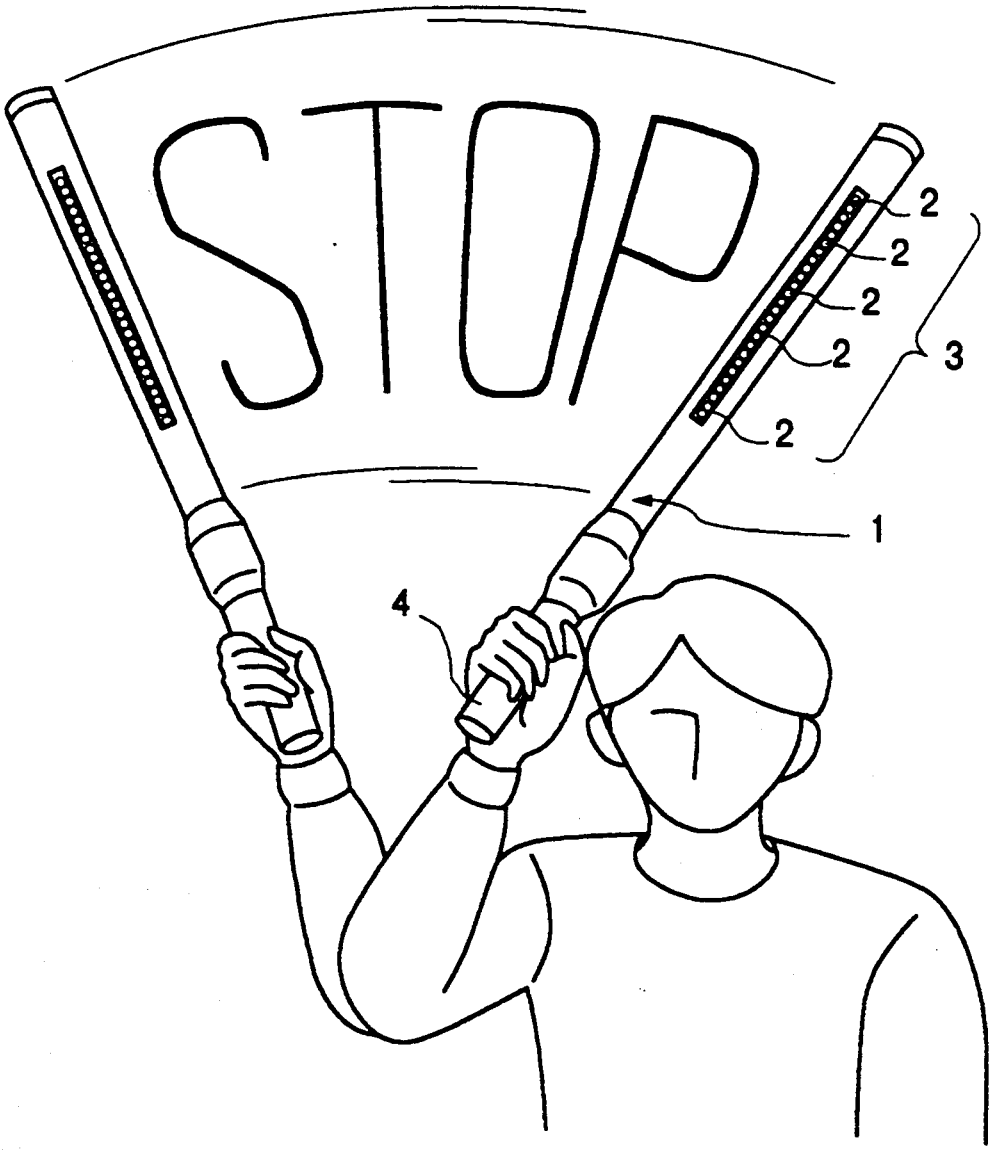
FIG. 1 is an illustration showing an example of application of an aerial display system according to the present invention, in which the system is applied to an illuminated stick to be used for traffic control.

Referring now to the drawings, particularly to FIG. 1, a general principle of the preferred embodiment of the aerial display system according to the present invention will be discussed in terms of an application for the illuminated stick. As shown in FIG. 1, the shown embodiment of the illuminated stick which is generally identified by the reference numeral 1, is adapted to form a visual display, e.g. the character message of "STOP" by swinging motion by the operator. As shown, the illuminated stick 1 is of generally elongated cylindrical configuration. A light emitting cell array 3 is mounted or installed on the front side surface of the stick 1. The light emitting cell array 3 is formed by a plurality of individual light emitting cells 2 which typically comprise light emitting diode (LED) arranged in alignment substantially in parallel to the longitudinal axis of the stick 1.

The stick 1 also has a grip portion 4 to be grasped by one hand of the operator. The operator may hold the stick for swinging above his head toward left and right, as shown, or back and forth. Therefore, the light emitting cells 2 of the light emitting cell array 3 are scanned in an aerial plane according to the manual swinging motion of the stick 1. Illumination timing of each of the individual light emitting cells 2 in the array 3 is controlled in a time sequence according to a predetermined schedule. By synchronization of illumination timings of the light emitting cells 2 with the swing motion of the stick 1, residual images of the illuminating light emitting cells 2 at the illuminated position can be assembled to form the visual image, e.g. "STOP" on the aerial plane.

For this purpose, the aerial display system includes a display control circuit which functions as follows. The display control circuit includes a memory which stores a display data corresponding to the desired visual image to be displayed in a form of a bit map. The display data is read out in a time sequence according to a given order at an appropriate or selected timing and speed. According to the read out display data, the display control circuit drives the light emitting cells 2 to selectively turn ON and OFF to illuminate selected cells at each moment. In order to switch all cells 2 simultaneously at each moment, the display control circuit drives all cells in the light emitting array 3 at the same timing. That is to say, a plurality of scanning lines on the aerial plane are simultaneously scanned by a plurality of light emitting cells in synchronism with the swing motion of the stick 1.

In case of an application using a machine operated equipment, synchronization of the illumination of the cells to the motion of the equipment may not be difficult since the machine may drive the equipment at regular timing. However, in case of the hand-held equipment, difficulty in synchronization of the timing is encountered due to substantial variation of the motion speed depending on the operators. Also, even in case of a single operator, the motion speed is variable from time to time and motion speed will fluctuate substantially even in one cycle of operation. Such fluctuation of the motion speed may result in instability of the image formed by the action.

In the prior art, there has been proposed one approach for establishing synchronization between the illuminating timing of the cells 2 and the motion of the stick. In the conventionally proposed approach, an audible sign, such as an electronic buzzer, is triggered immediately before initiation of selective illumination of the cells so that the operator may initiate swing motion in synchronism with initiation of illumination of the cells. When a phase synchronization between the selective illumination cycle and reciprocal motion of the stick can be established, desired image becomes visual in the desired configuration. However, to establish such phase synchronization requires much practice. If phase synchronization cannot be established, drop out of the edge of the image, partial reversal of the image, or expansion or contraction of the image in the scanning direction may result.

Another conventionally proposed approach is to employ a movable pendulum with a mechanical switch mechanism operated by the pendulum. The pendulum is adapted to cause action in response to an acceleration induced by the swing motion of the stick. The pendulum turns ON the mechanical switch at a certain position in the motion stroke to initiate illumination of the cells. With such construction, illumination of the cells can be initiated by swing motion. However, it is still difficult to turn the switch at an appropriate timing. Particularly, at reversal of the motion direction, it is difficult to turn the switch for reversal of the scanning direction in synchronism therewith. Therefore, similar to the former approach, a lot of practice is required to swing the stick in an appropriate manner for forming the desired image.

The aerial display system according to the present invention solves the problems set forth above and realizes aerial display without requiring any skill in operating the equipment, e.g. the illuminated stick.

Figure 2:
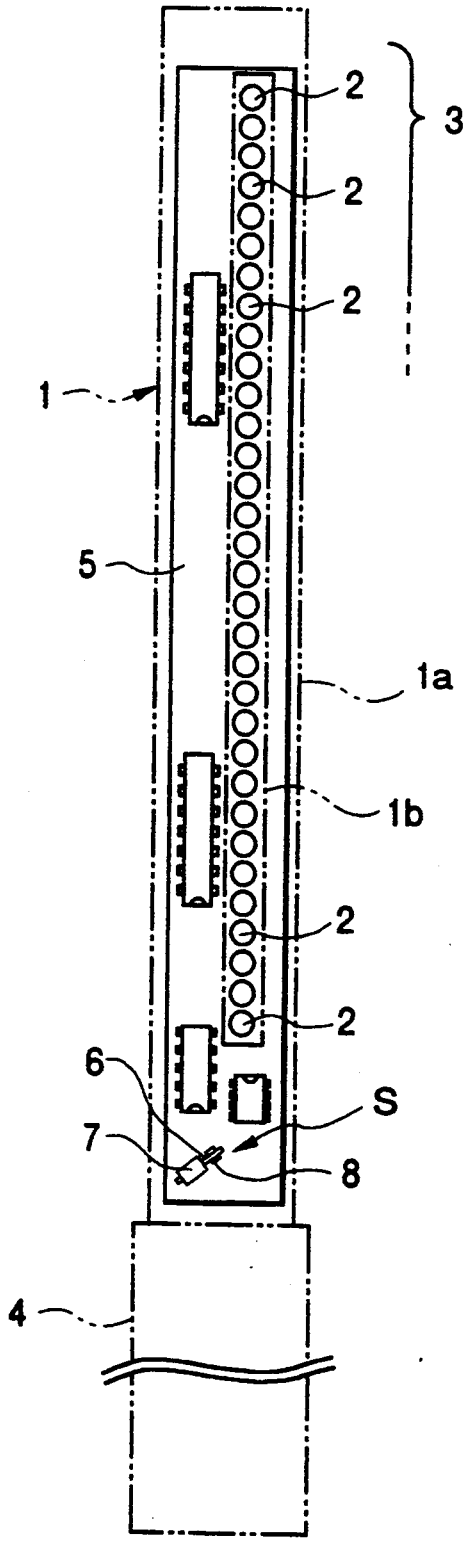
FIG. 2 is a fragmentary front elevation of the preferred embodiment of an illuminated stick with the aerial display system of the invention, in which an outer casing is removed in order to show the internal structure.

As shown in FIG. 2, an elongated rectangular printed circuit board 5 is disposed within a cylindrical casing 1*a* of the stick 1. A plurality of LEDs as the light emitting cells 2 are mounted in alignment substantially in an axial direction at regular intervals to form the light emitting cell array 3. In the shown embodiment, thirty-two LEDs are mounted on the printed circuit board 5. As can be seen from FIG. 1, the cylindrical casing 1*a* of the stick 1 is formed with a transparent window 1*b* at the position corresponding to the light emitting cell array 3 so as to expose the array to the external sight therethrough. Also, a display control circuit in the form of an IC chip is mounted on the printed circuit board 5 and electrically connected to respective of the individual LEDs 2. A motion sensor assembly S is also mounted on the printed circuit board 5 in the vicinity of the longitudinal end adjacent the grip portion 4. The motion sensor assembly S comprises a guide rail 6, a slider 7 slidably supported on the guide rail and a position sensor 8 for detecting the slider 7. Construction of the display control circuit and the motion sensor assembly S will be discussed in detail later. The grip portion defines a battery receptacle chamber for receiving one or more batteries as the power source for the aerial display system.

Figure 4:
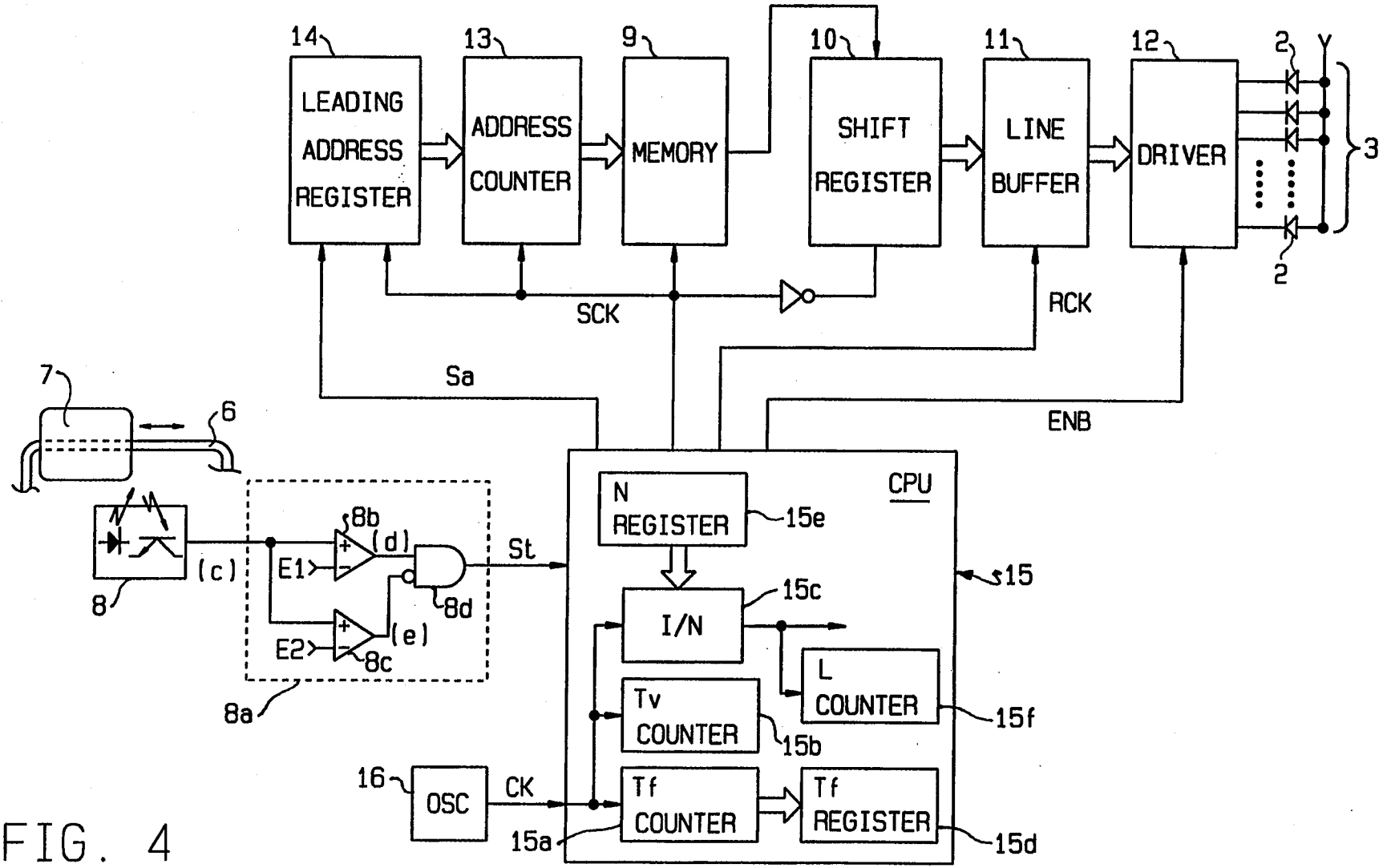
FIG. 4 is a block diagram of a control circuit of the preferred embodiment of the aerial display system according to the invention.
Figure 5:
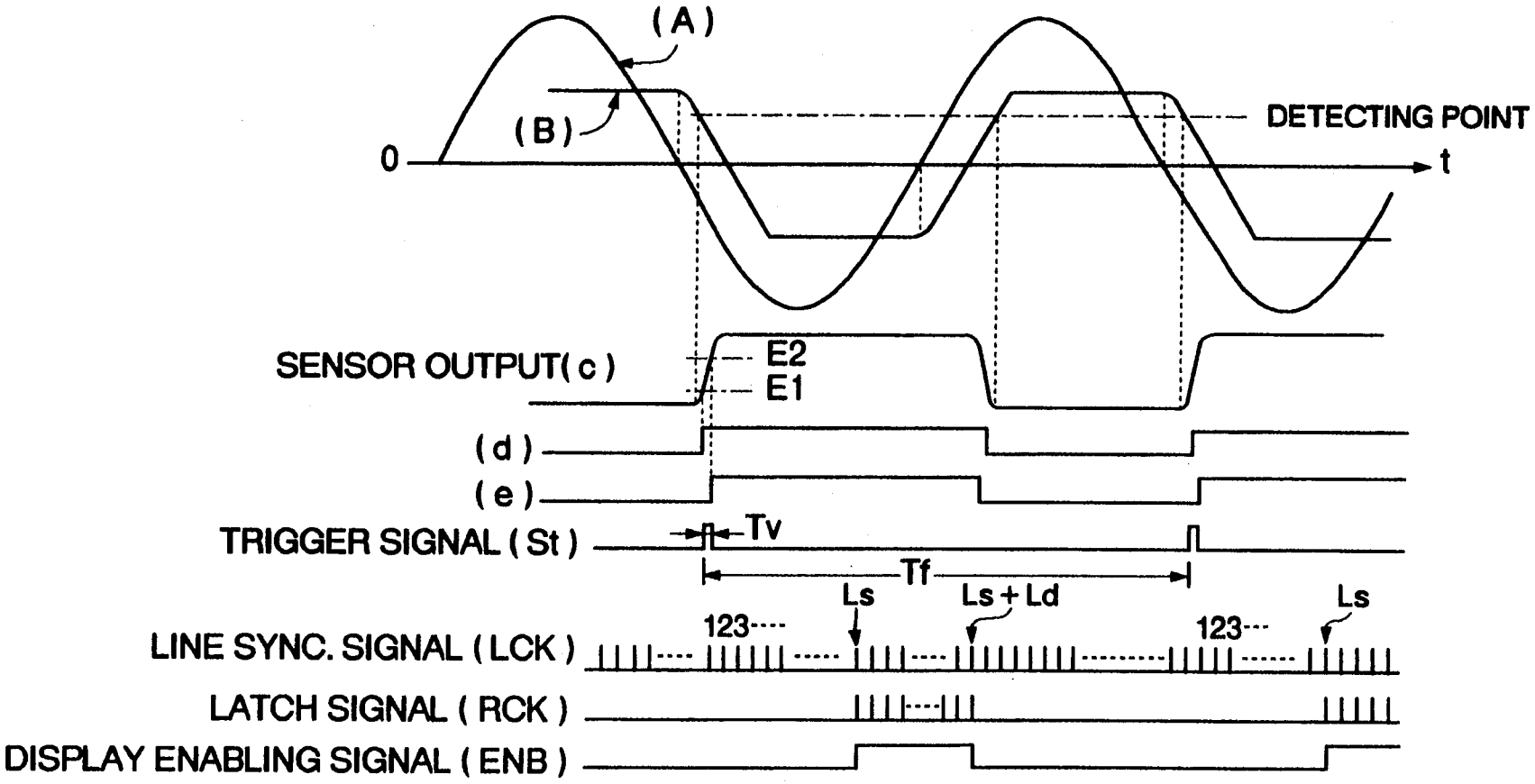
FIG. 5 is a timing chart showing operation of the preferred embodiment of the aerial display system according to the invention.

FIG. 4 shows one embodiment of the display control circuit to be employed in the shown embodiment of the aerial display system and mounted on the printed circuit board 5. FIG. 5 shows a timing chart showing operational timing of the display control circuit of FIG. 4.

In FIG. 4, the display control circuit includes a memory 9 which stores display data in the form of a bit map. The display data in the memory 9 is read out at an appropriate speed in a given order per each bit and input to a shift register 10. The shift register 10 is adapted to shift the read out bit data over 32 bits. Once 32 bits of display data are input, the shift register 10 transfers the 32 bit display data, which is one line of display data in the shown embodiment, to a line buffer 11. A driver 12 is adapted to produce driver signals to drive respective of thirty-two LEDs according to respective of corresponding bits of display data. As can be appreciated, each one bit of the display data represents ON/OFF state of the corresponding LED. Address of the memory 9 to be accessed upon reading out each bit of the display data is applied from an address counter 13. The address counter 13 is adapted to be preset at a leading address every time of initiation of reading out of the display data.

Timing of a sequence of operation for displaying the image is controlled by a microprocessor 15. The microprocessor 15 performs control to establish synchronization between the swing motion of the stick 1 and display control on the basis of the output of the motion sensor assembly S.

Figure 3:
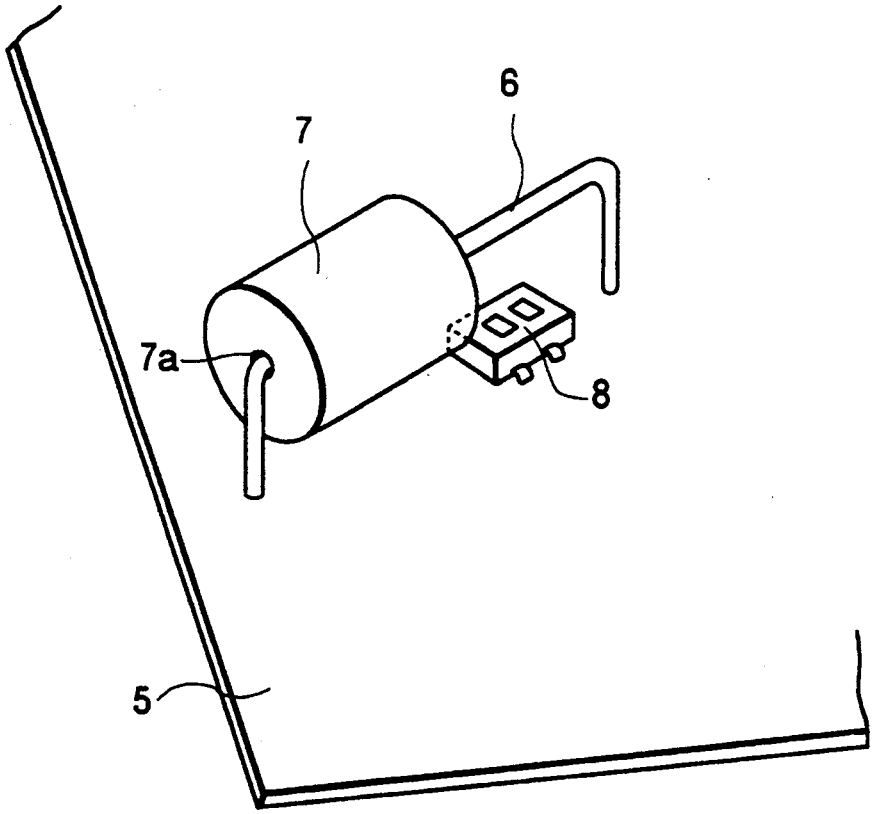
FIG. 3 is a perspective view of a motion sensor to be employed in the preferred embodiment of an aerial display system according to the invention.

FIG. 3 shows in an enlarged scale the motion sensor assembly S employed in the embodiment of FIG. 2. In FIGS. 2, 3 and 4, the slider 7 is formed by a cylindrical body with an appropriate mass weight. The cylindrical slider 7 defines a center hole 7*a*, through which the guide rail 6 extends. The slider 7 is thus smoothly movable along the guide rail 6. Both ends of the guide rail 6 are bent at substantially right angle to form legs for mounting the guide rail on the printed circuit board 5. The legs of the guide rail 6 may be rigidly secured to the printed circuit board 5 by way of soldering or any other appropriate means. The straight portion of the guide rail 6 between the legs defines a range, in which the slider 7 moves. As can be seen from FIG. 3, the length of the straight portion of the guide rail 6 is substantially double the axial length of the slider 7 so as to provide a slider stroke length substantially corresponding to the axial length of the slider.

Also, as shown, the guide rail 6 has an axis oriented in oblique to the alignment direction of the light emitting cell array 3 (i.e. the axial direction of the stick 1). In the preferred embodiment, the axis of the guide rail 6 is angled relative to the alignment direction of the light emitting cell array 3 at 60°. Therefore, when the operator grips the grip portion 4 and situates the stick 1 at substantially vertical position, the slider 7 is placed at the lower left end of the straight portion of the guide rail 6. This slider position will be hereafter referred to as "leftward stroke end position". Similarly, the slider position where the slider is placed at the opposite right side end of the straight portion, will be hereafter referred to as "rightward stroke end position".

The position sensor 8 is adapted to detect the slider 7 moving along the guide rail 6 in a non-contacting manner. In this particular embodiment, the position sensor 8 is arranged to detect the slider 7 at the intermediate position between the leftward and rightward stroke end positions. Various non-contact type sensors suitable for detecting motion of the slider may be employed. In the preferred construction, a reflection type photo-interrupter is employed to form the position sensor 8. The position of the position sensor 8 relative to the slider stroke is determined to provide following operational characteristics, as can be clear from FIG. 4.

(1) When the slider 7 is placed at the leftward stroke end position, a reflected light beam of a light beam emitted from a light emitting portion is not received by a photosensing portion. Therefore, the output of the position sensor 8 is maintained at LOW level.

(2) When the slider 7 moves toward right from the leftward stroke end position slightly (over a preset magnitude), the leading (right side) end of the slider 7 reaches the position opposite the position sensor 8. Then, a pair of the light beams from the light emitting portion are reflected and received by the photosensing portion to raise the output level of the position sensor. According to rightward movement of the slider, the amount of the light beam reflected toward the photosensing portion is increased to further raise the output level of the position sensor. Therefore, in the transition period, the output of the position sensor 8 increases with a gradient proportional to the stroke speed of the slider 7 in analogous fashion. At the position where the slider 7 fully opposes the position sensor 8, the output level of the position sensor 8 becomes maximum which corresponds to HIGH level.

(3) Even at the rightward stroke end position, the slider 7 is held fully opposing to the position sensor 8. Therefore, the output level of the position sensor 8 may be held at HIGH level.

Now, discussion will be given for a relationship between the swing motion of the stick 1, the slider motion and the output of the position sensor 7 with reference to FIG. 5.

In a case where the stick 1 oriented vertically is swung left and right while gripping the grip portion 4, the variation of the position of the tip end of the stick 1 can be illustrated as curve (A) in FIG. 5. It should be noted that the reference line (0) in the shown chart is set at the position of the stick 1 oriented in upright fashion. According to swing motion of the stick 1, the slider 7 of the motion sensor assembly S moves reciprocally between the leftward and rightward stroke end positions. The curve (B) in FIG. 5 represents the variation of the slider position with consistent time axis to the curve (A) of the motion of the tip end of the stick 1.

In the typical manual swing operation of the stick 1, the swing speed of the stick is accelerated from the swing initiating position to an intermediate position and then decelerated to reach the swing terminating position. That is to say, the direction of the acceleration is differentiated at substantially mid-way of the swing motion. The slider 7 is responsive to reversal of the direction of acceleration by moving from one end (leftward stroke end position) to the other end (rightward stroke end position). In addition, the slider movement speed may substantially correspond to the swing speed substantially at the mid-point of the swing stroke range. Such relationship should be clear from the curves (A) and (B).

Variation of the output of the position sensor 8 relative to the motion of the slider 7 according to the characteristics illustrated by the curve (B) is illustrated by the curve (C) in FIG. 5. As set out in detail above, the output level of the position sensor 8 starts rising from the LOW level at the leftward stroke end position toward HIGH level after initiation of motion of the slider 7 at a variation rate (gradient) proportional to the swing speed, and returns to the LOW level immediately before the slider returns to the leftward stroke end position.

The output of the position sensor 8 as illustrated by the curve (c) in FIG. 5 is converted into binary values by means of two comparators 8*b* and 8*c* with two mutually different threshold values E1 and E2. By processing these two binary outputs (d) and (e) at a gate 8*d*, a trigger signal St is obtained. As can be clear from FIG. 5, the trigger signal St rises at a timing where the slider 7 is slightly shifted from the leftward stroke end position, i.e. corresponding to the timing where the stick 1 passes across the mid-point of the swing stroke in a predetermined direction. The pulse width Tv of the trigger signal St becomes inversely proportional to the swing speed of the stick 1 at the substantially mid-point. Also, the period of the trigger signal St substantially corresponds to the swing period of the stick 1.

Figure 6:
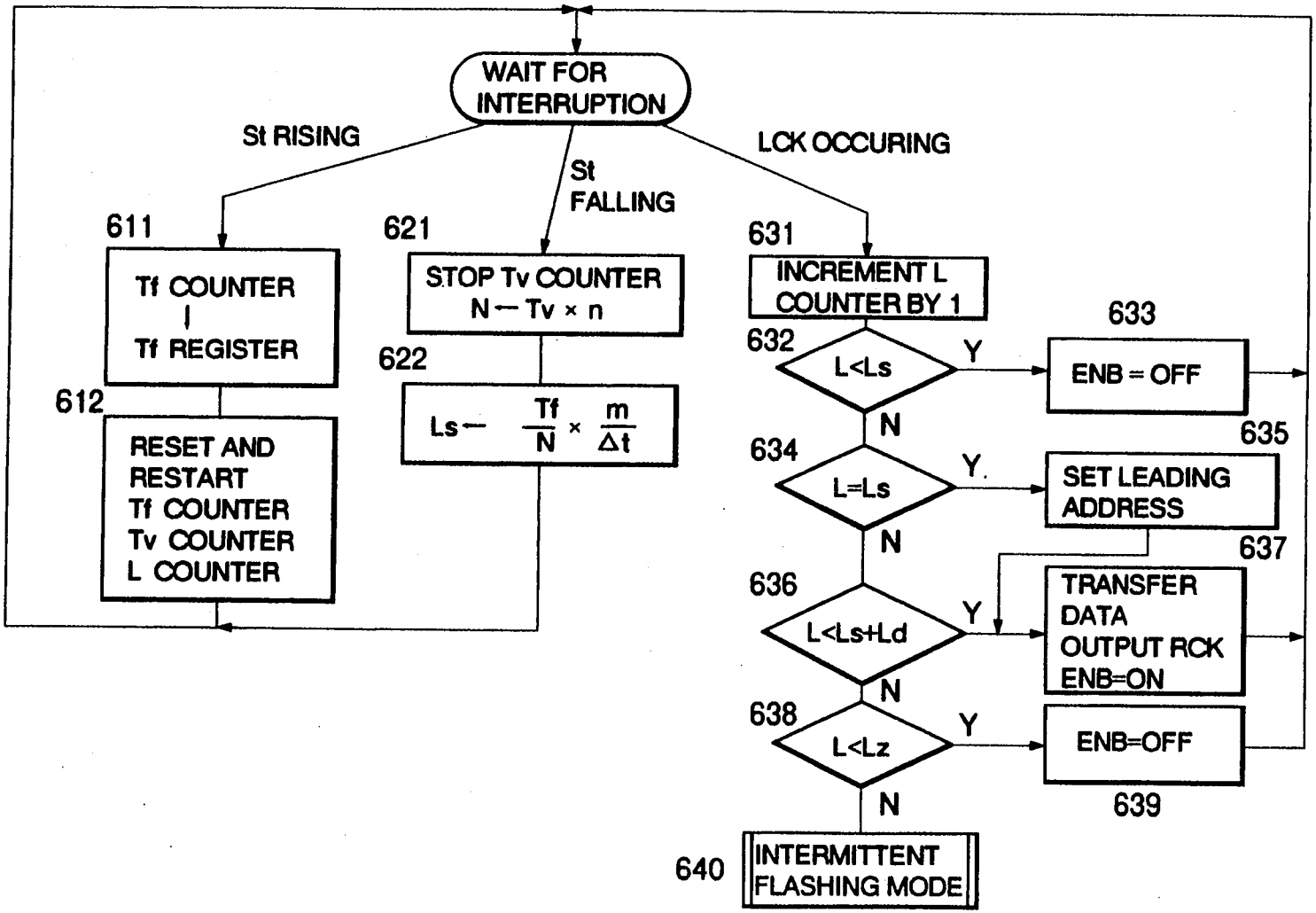
FIG. 6 is a flowchart showing a process for controlling the preferred embodiment of the aerial display system according to the invention.

The microprocessor 15 performs timing control for the aerial display on the basis of the trigger signal St and a reference clock signal CK generated by a clock oscillator 16 with sufficiently high frequency. The process of control to be executed by the microprocessor 15 is shown in FIG. 6.

As shown in FIG. 4, the microprocessor 15 is provided with two counters 15*a* and 15*b* incremented by the reference clock signal CK, and a frequency divider 15*c* dividing the reference clock signal CK into 1/N to generate a light synchronization signal LCK which will be discussed later.

Every rise time of the trigger signal St, a counter value Tf of the counter 15*a* is transferred to a register 15*d*. The counter 15*a* is reset and restarts the counting operation (steps 611 and 612 of FIG. 6). Namely, the counter measures the period Tf of the trigger signal St and stores the measured value Tf in the register 15*d* at every cycle.

Another counter 15*b* is also reset and restarted in response to the leading edge of the trigger signal St (step 612). The counter 15*b* terminates counting in response to the trailing edge of the trigger signal St. The counted value Tv of the counter 15*b* is then read out and used in a process for determining a frequency dividing rate N (step 621). Namely, the counter 15*b* measures the pulse width Tv of the trigger pulse St (i.e. an inversely proportional value to the swing speed) for updating the frequency dividing rate N from time to time on the basis of the measured value Tv.

The line synchronization signal LCK which is generated by frequency division of the reference clock signal CK into 1/N may serve as a latch signal RCK (which determines an output speed of the data) for updating data of the line buffer 11, as will be discussed later. Furthermore, the line synchronization signal LCK serves as a reference signal for measuring a delay period from the occurrence of the trigger signal St to initiation of display.

At a step 621, the trigger signal pulse width Tv obtained from the counter 15*b* at the trailing edge of the trigger signal St is multiplied by an appropriate constant n so that the product is set in a register 15*e* as the frequency dividing rate N. The frequency divider 15*c* divides the reference clock signal CK with the value N stored in the register 15*e* to generate the line synchronization signal LCK. Accordingly, greater pulse width Tv (smaller actual swing speed 1/Tv) results in greater frequency dividing rate N and thus results in greater period T1 of the line synchronization signal LCK (i.e. smaller frequency F1 of the line synchronization signal LCK). Assuming the period of the reference clock signal CK is $\Delta t$, the period T1 of the line synchronization signal LCK becomes ($\Delta t \times N$).

At every occurrence of the line synchronization clock signal LCK, a line counter 15*f* is incremented (step 633). The line counter 15*f* is reset every rise time of the trigger signal St. Namely, the line counter 15*f* counts number of pulses of the line synchronization signal LCK from the time, at which the trigger signal St occurs. Hereafter, the counted value of the line counter 15*f* will be referred to as "line number L".

During a period from the occurrence of the trigger signal St to reach the line number L to Ls, a display enabling signal ENB to be applied to the driver 12 is maintained in an OFF state. In this state, all LEDs 2 in the light emitting cell array 3 are held OFF (step 632 to 633). When the line number L reaches to Ls, a given leading address is set in a leading address register 14. Also, at the same time, a predetermined data transfer signal SCK is generated so that the first line of the predetermined display data is read out from the memory 9. The read out display data for the first line is latched in the line buffer 11 in response to the latch signal RCK. Furthermore, the display enabling signal ENB is turned ON (steps 634, 635 to 637). By this, the thirty-two LEDs in the light emitting cell array 3 are selectively driven ON and OFF according to the leading one line data (32 bits) of the display data stored in the form of the bit map.

Subsequently, at every occurrence of the line synchronization signal LCK, the read out line of the display data is shifted until the line number L1 reaches (Ls+Ld). Based on each line data, the LEDs 2 in the array 3 are driven (steps 636 to 637). It should be noted that Ld represents number of lines of the display data.

When the line number L becomes greater than or equal to (Ls+Ld), the display enabling signal ENB is maintained OFF until the line number L reaches a predetermined value Lz which is set at a suitably large value to permit judgement that stick 1 is at rest. Then, all of the LEDs 2 in the light emitting cell array 3 are held OFF (steps 638 to 639). When the line number L becomes greater than or equal to Lz, judgement is made that the stick 1 is not swung any more. Then, operation mode is switched into another mode, in which a predetermined or appropriate number of LEDs 2 in the light emitting cell array 3 flash intermittently (steps 638 to 640). This mode will be hereafter referred to as "intermittent flashing mode". It should be noted that when the trigger signal St occurs, the operation mode is automatically switched from the intermittent flashing mode to the normal display mode.

In the display control process as set forth above, the number of lines Ls to initiate displaying and reading out the display data is not fixed and can be variably set through the process at a step 622 which is executed in response to the trailing edge of the trigger signal St.

As set forth above, the frequency dividing rate N is determined corresponding to the pulse width Tv of the trigger signal St. The display initiation line number Ts is determined depending upon this frequency dividing rate N and the swing period Tf. Since the signal obtained through frequency division of the reference clock CK into 1/N is the line synchronization signal LCK, when the period of the reference clock CK is Δt, the period T1 of the line synchronization signal LCK is (Δt×N). A quotient derived by dividing the swing period Tf by (Δt×N) is the number of total lines in one cycle. A product derived by multiplying a value less than or equal to 1 by the quotient is set as the display initiation line number Ls. For instance, assuming the number of total lines in one cycle is 100, the display initiation line number Ls may be set at 40. At the step 622, Ls is derived by calculation of (Tf/N×(m/Δt), where m is constant.

Association between the display control to be performed as set forth above and the swing motion of the stick 1 will be discussed with reference to FIG. 7.

Here, since the period T1 of the line synchronization signal LCK is (Δt×N) as set forth above, the delay period $T_{delay}$ from occurrence of the trigger signal St to initiation of the display out can be expressed by the following equation:

$$T_{delay}=T1\times Ls=\Delta t\times N\times Ls$$
$$\Delta t\times N\times(Tf/N)\times(m/\Delta t)=Tf\times m$$

Therefore, (m×100)% of the swing period Tf becomes the delay period. Namely, the delay period varies in proportion to the swing period Tf. On the other hand, since the display speed is inversely proportional to the period (T1=Δt×N=Δt×Tv×n) of the line synchronization signal LCK, greater swing speed (1/Tv) (smaller inversely proportional value to the swing speed as derived by the counter 15*b*) results in higher display speed.

Figure 7:
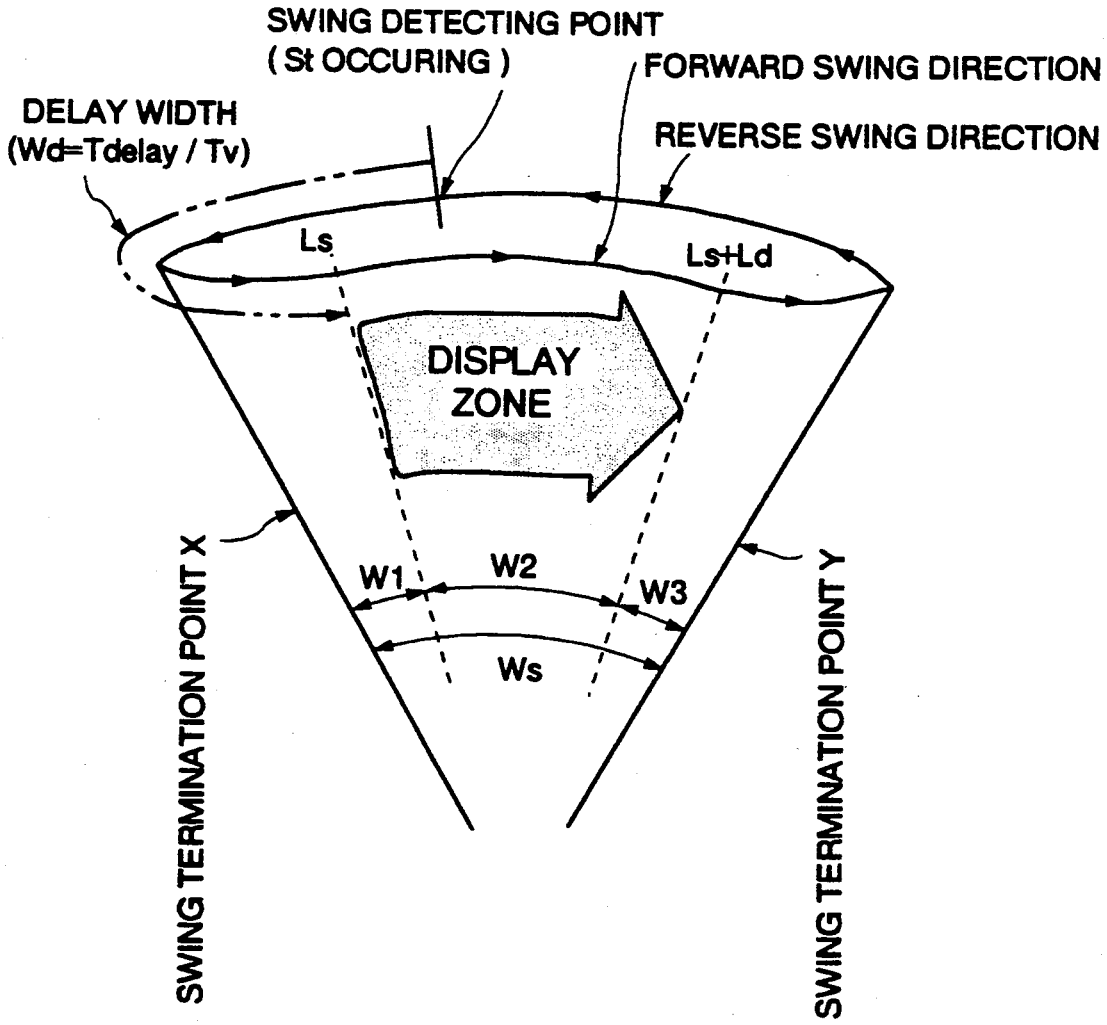
FIG. 7 is an explanatory illustration showing the operation of the preferred embodiment of the aerial display system of the invention.

As shown in FIG. 7, it is assumed that the swing stroke width between swing termination points X and Y is Ws, a non-display zone width from the swing termination point X to the display initiation line Ls is W1, a display zone width from the display initiation line Ls to the display termination line (Ls+Ld) is W2, and a non-display zone width from the display termination line to the swing termination point Y is W3. Also, assuming that a product ($T_{delay}$/Tv) derived by multiplying the delay period $T_{delay}$ by the swing speed 1/Tv is delay width Wd, the non-display zone width W1 is substantially proportional to the delay width Wd.

Comparison will be made between the case (1) where the swing motion is repeated at a certain swing width Ws at a given speed and the case (2) where the swing motion is repeated at the same swing width Ws at a speed double the given speed. In case (2), the swing speed 1/Tv becomes double that of the case (1), and thus the swing period Tf becomes half that of the case (1). Although halfing the swing period Tf results in halfing the delay period $T_{delay}$, the delay width Wd remains substantially the same since the swing speed of the stick 1 is double. Accordingly, in either case, the non-display zone width W1 will be unchanged. Similarly, when the swing speed 1/Tv becomes double, the display speed becomes double (the display period in the display zone is halved). However, since the stick 1 is shifted at twice the speed of that in the case (1), the display zone width W2 is also held unchanged. As can be appreciated. as long as the swing width Ws is constant, the non-display zone width W1, the display zone width W2 and the non-display zone width W3 are held substantially unchanged irrespective of the swing speed. Therefore, the position and size of the visual image aerially displayed by repeated swing motion of the stick 1 can be held substantially constant.

Another comparison is made between the case (3) where the stick 1 is swung in a certain swing width Ws in a certain swing period Tf and the case (4) where the stick is swung in a swing width double that of Ws in the case (3) in the swing period double that of the case (3). In case of (4), the swing speed 1/Tv is equal to that of the case (3). Doubling the swing period results in a doubling of the delay period $T_{delay}$. Since the stick 1 moves at a speed equal to that in the case of (3), the delay width Wd becomes substantially double that of the case (3). Accordingly, the non-display zone width W1 is doubled. Similarly, since the swing speed 1/Tv is equal, the display speed is equal to that of the case (3), and the display width W2 is held unchanged. Namely, even when the swing width Ws is increased, the display zone width W2 is held unchanged and only the non-display zone width W1 is changed. Therefore, even when the swing width Ws is changed, variation of the position of the visual image to be formed is little.

A further comparison is made between the case (5) where the stick 1 is swung within a certain swing width Ws with a certain period Tf, and the case (6) where the swing period Tf is equal to that of the case (5) and the swing width is double that of Ws in the case (5). In the case of (6), the swing speed 1/Tv becomes double of that in the case of (5). If the swing period Tf is the same, the delay period $T_{delay}$ becomes the same. Since the stick 1 moves at double the speed of that of the case (5), the delay width Wd becomes substantially double that of the case (5). Accordingly, the non-display zone width W1 becomes substantially double (period width of the display zone becomes half). However, since the stick 1 moves substantially twice the speed of that in case (5), the display zone width W/2 can be held substantially unchanged. Namely, as in the former examples, even when the swing width Ws is expanded, the display zone width W2 (the size of the visual image to be formed) can be held substantially unchanged, and only the non-display zone width W1 is varied so that the position to aerially form the image can be held stable.

In case that the stick 1 is manually swung in reciprocating fashion, the swing period and the swing speed may vary in an irregular fashion. However, the magnitude of variation is not as large as the foregoing examples. Also, the variation is typically caused in non-abrupt manner. Accordingly, by the composite effect of the automatic adjustment mechanism for the delay period and the display speed as set forth above, the aerially formed image formed by repeated swing motion of the stick 1 can be very stable and continuous for facilitating visual recognition.

Although the shown embodiment set forth above is designed to perform the automatic adjustment of the delay period and the automatic adjustment of the display speed in a composite manner, substantial improvement in stabilization of the display image can be attained by employing either one of automatic adjustment functions. When the assumption can be made that the variation magnitude of the swing width Ws of the stick 1 is so small as to be ignored in practical use, the swing period Tf and the trigger signal pulse width Tv (which is the reciprocal of the swing speed) can be considered as mutually proportional parameters. Therefore, in such a case, either or both the automatic delay period control or the automatic display speed control can be taken place using one swing period Tf and the trigger signal pulse width Tv. The automatic adjustment systems may be selected and combined depending upon concrete application, task to be achieved, conditions of use, cost or other factors.

Although the foregoing embodiment illustrated in FIGS. 4, 5 and 6, derives the frequency dividing rate N of the frequency divider 15*c* depending upon the pulse width Tv of the trigger signal St, the frequency dividing rate N may be derived through various processes. For instance, in the alternative embodiment, the frequency dividing rate N is derived through the following process. Similarly to the foregoing embodiment, it is assumed that the swing period is Tf, the period of the reference clock signal CK is Δt. Also, in this embodiment, the total line number in one cycle is arbitrarily set at a given number $L_{max}$ through the following process. Then, the frequency dividing rate N is derived on the basis of the swing period Tf detected by the counter 15*a* through the following equation:

$$N = Tf/(L_{max} \times \Delta t)$$

As will be appreciated, when the frequency dividing rate N thus derived is used, the display initiation line number Ls becomes constant. Therefore, it becomes unnecessary to perform the process for varying the display initiation line number Ls depending upon the swing period Tf.

Employing the manner of derivation of the frequency dividing rate N set forth above, the non-display zone width W1, the display zone width W2 and the non-display zone width W3 will be varied in proportion to the swing width Ws illustrated in FIG. 7. Namely, the width of the displayed image varies depending upon the swing width Ws. Such manner of automatic adjustment of the aerial display may be useful in certain applications or in certain methods of use.

In the shown type of the aerial display system, accuracy of detection of the swing motion of the stick 1, and the reliability and stability thereof are critical factors for determining the fundamental performance of the system. In the embodiment illustrated in FIGS. 2, 3 and 4, the motion sensor assembly S employs the slider 7 which moves reciprocally along the guide rail 6 across the position opposite to the position sensor 8 in a non-contacting manner so that the position sensor 8 may detect the slider position. Since the slider 7 can be designed to have such high response characteristics as to cause slider movement even at light force, it can respond to the reversal of the acceleration of the stick 1 during swing motion with high response characteristics, with no interference in motion, so that the slider position may precisely reflect the position of the stick 1 in motion. Therefore, the swing motion of the stick 1 can be precisely and steadily detected at a fixed operational point. Accordingly, for automatic adjustment of the delay period and/or the display speed, the display initiation timing and the swing motion of the stick 1 can be precisely synchronized. This permits stable aerial display of the desired image without requiring substantial skill in swinging the stick 1.

Although the shown embodiment employs the photo-interrupter type position sensor as set forth above, various position sensors may be employed without significantly changing the performance of the aerial display system. For example, a Hall element may be used as the position sensor. In such case, the slider 7 may be provided with a magnet so that the Hall element may magnetically detect the position thereof. Also, though the shown embodiment derives the swing speed information Tv by converting the analog output of the position sensor 8 with two threshold values E1 and E2 and by measuring a difference of the timing of occurrences of the thus converted binary signals, the swing speed may be detected in various ways. For instance, when the position sensor of a type which does not output an analog signal suitable for applying the foregoing method is employed, the swing speed of the stick may be detected by positioning two position sensors with a small interval so that the swing speed information Tv may be detected on the basis of the difference of the detection timing therebetween.

As set forth above, with the shown embodiment, the slider as an acceleration responsive movement may stroke between both stroke ends in response to reversal of the direction of the acceleration. This can be detected by the position sensor in a non-contacting manner. Therefore, the detection signal of the position sensor can be obtained with high certainty irrespective of the magnitude of the operational force applied to the stick 1 for swing motion. Since the trigger signal for display control can be obtained from the output of the position sensor, appropriate synchronization between the swing motion of the stick and the display initiation timing in the display control can be precisely established.

An alternative embodiment, in which an acceleration sensor is employed as the motion sensor assembly, will be discussed herebelow.

Figure 8:
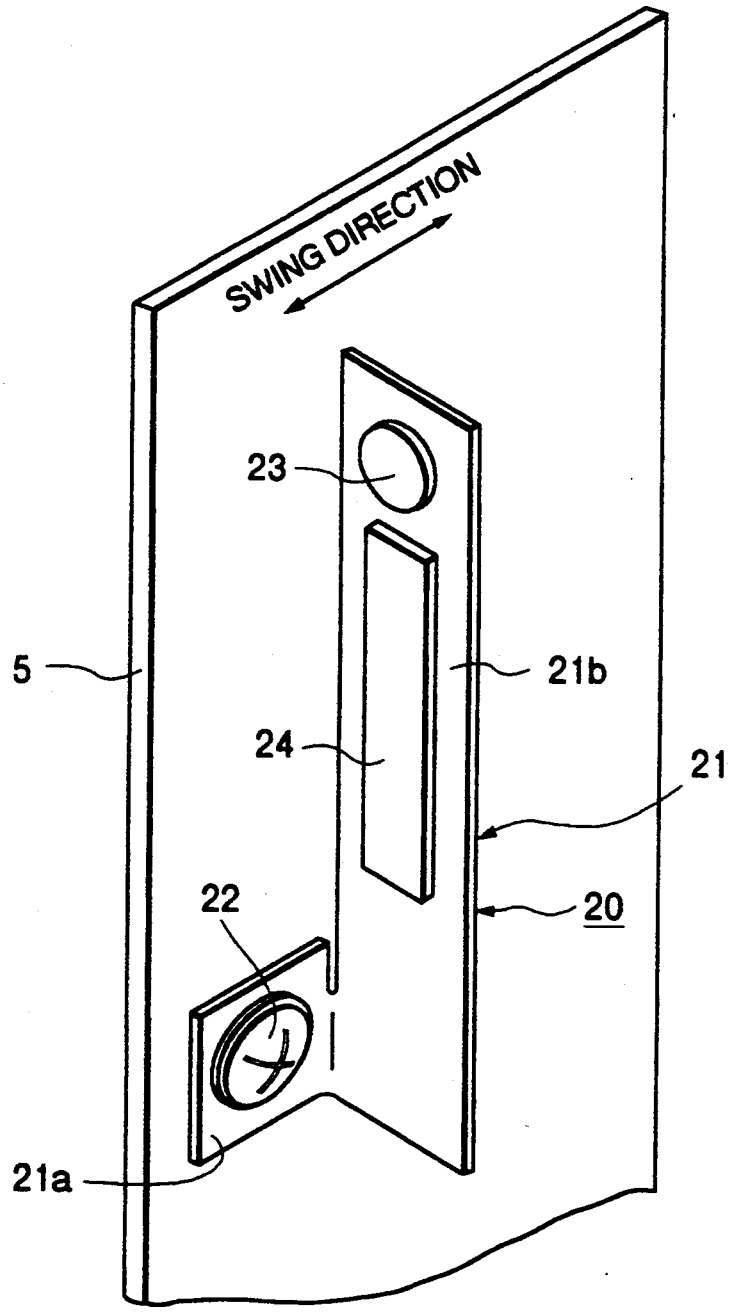
FIG. 8 is a perspective view of another construction of a motion sensor to be employed in the preferred embodiment of the aerial display system according to the invention.

FIG. 8 shows a mechanical construction of the acceleration sensor forming the motion sensor assembly for the aerial display system according to the present invention. In the shown construction, an acceleration sensor 20 is mounted on the printed circuit board 5 at a position in the vicinity of the tip end of the printed circuit board. Similarly to the foregoing embodiment, the printed circuit board 5 supports the light emitting cell array, and the IC chip or chips of the control circuit. The acceleration sensor 20 includes a base 21 formed of a leaf spring. The base 21 has a mounting portion 21*a* and a cantilevered movable portion 21*b* which is formed into generally an elongated rectangular configuration and extends substantially perpendicular to the mounting portion. The mounting portion 21*a* is firmly fixed to the printed circuit board 5 by means of a fastening screw 22. As can be seen from FIG. 8, the movable portion 21*b* is oriented to be in a plane substantially perpendicular to the plane of the printed circuit board while the longer edge extends substantially parallel to the axis of the light emitting cell array 3. A pendulum 23 is mounted in the vicinity of the tip end of the movable portion 21*b*. Also, a strain gauge 24 is rigidly mounted on the intermediate section of the movable portion 21*b*.

Figure 9:
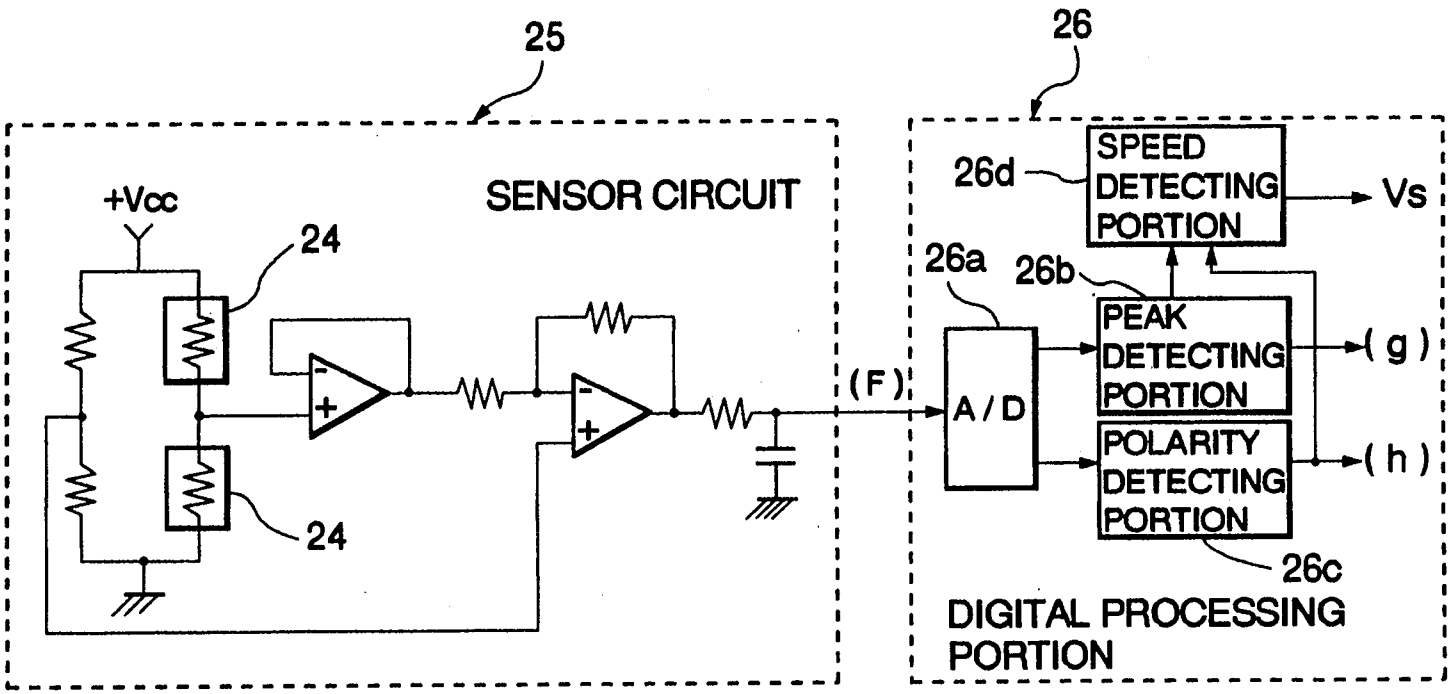
FIG. 9 is a block diagram showing a signal processing circuit in the control circuit, which is associated with the motion sensor of FIG. 8.
Figure 10:
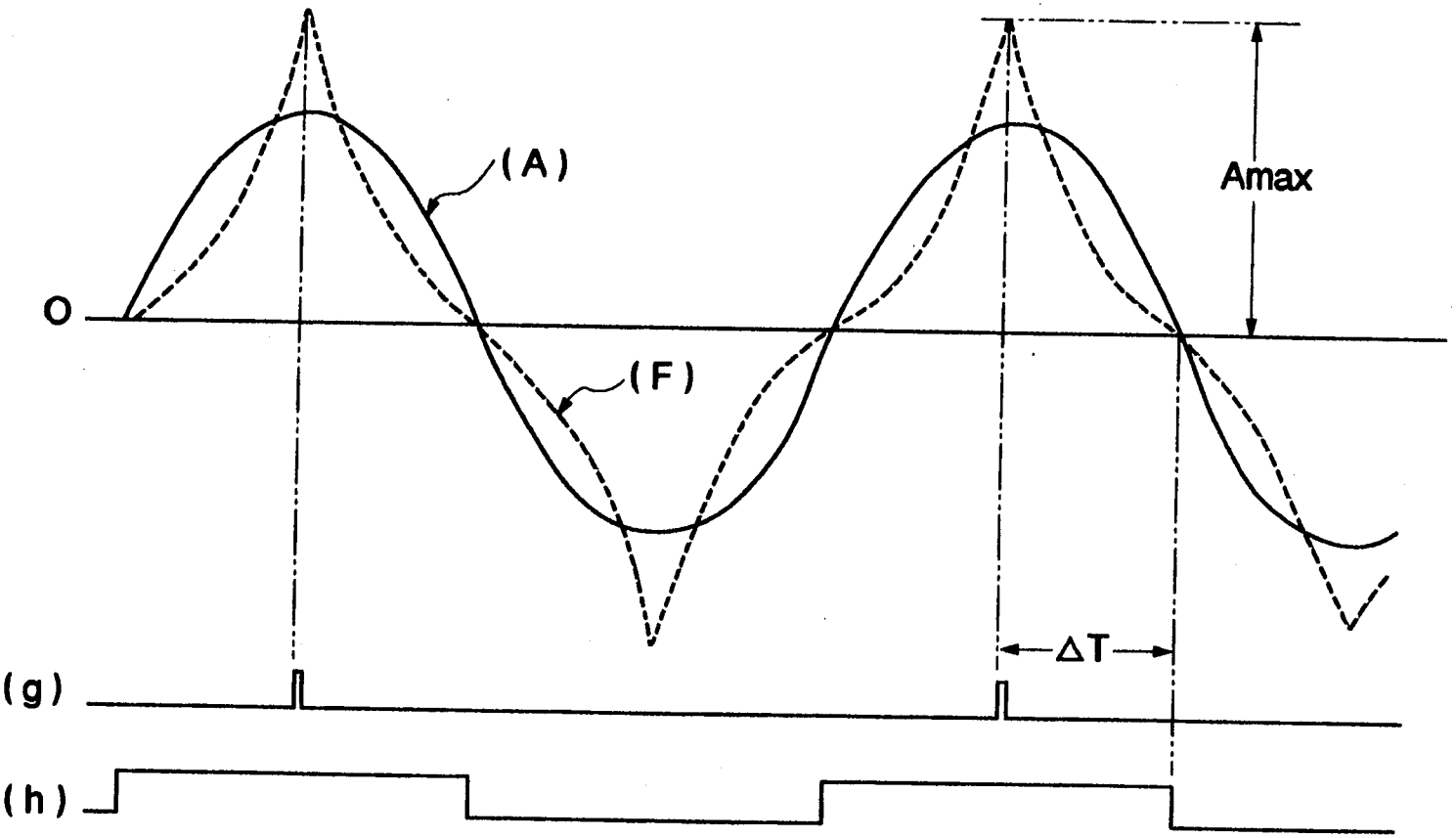
FIG. 10 is a timing chart showing operation of the motion sensor of FIG. 8.

When the stick 1 is swung, the acceleration induced by the swing motion is exerted on the pendulum 23 as well as the movable portion 21*b*. As can be appreciated, the acceleration is exerted on the movable portion 21*b* in substantially perpendicular direction to the plane thereof. In response to the acceleration, the movable portion 21*b* is distorted. The strain gauge 24 converts the distortion magnitude of the movable portion 21*b* into an electric signal. As shown in FIG. 9, the strain gauge 24 forms a part of a sensor circuit 25. The sensor circuit 25 outputs a detection signal F almost linearly corresponding to the acceleration exerted due to the swing motion of the stick 1, as shown in FIG. 10. In FIG. 10, a characteristic curve (A) represents the variation of the position of the tip end of the stick 1 discussed with respect to FIG. 5 and the characteristic curve (F)represents the corresponding output of the acceleration sensor 20.

The output (F) of the acceleration sensor 20 very precisely reflects the swing motion of the stick 1, facilitating processing therefor and display control utilizing the same. In the embodiment of FIG. 9, a digital processing portion 26 processes the sensor output (F) in the following manner. The sensor output (F) is initially converted into a binary value by an analog-to-digital (A/D) converter 26*a*. The converted binary value is supplied to a peak detecting portion 26*b* and a polarity detecting portion 26*c*. As seen from FIG. 10, the peak detecting portion 26*b* detects both a peak value $A_{max}$ and peak timing (g). The polarity detecting portion 26*c* produces a polarity indicative binary signal (h) which varies between HIGH and LOW levels depending upon the output level (F) with respect to a zero level. Then, a speed detecting portion 26*d* derives the difference in timing $\Delta T$ between the peak timing (g) and the trailing edge of the HIGH level polarity indicative binary signal (h) and multiplies thus derived timing difference $\Delta T$ with the peak value $A_{max}$ to derive a value Vs serving as the swing speed data. Also, the speed detecting portion 26*d* generates a trigger signal St in synchronism with the falling or rising of the polarity indicative binary signal (h). By setting the pulse width of the trigger signal St in a magnitude inversely proportional to the swing speed data Vs, a display control equivalent to that discussed with respect to FIG. 4 can be realized. Of course, the period of the trigger signal St corresponds to the swing period.

With the shown embodiment, since the acceleration sensor may generate an output signal precisely reflecting the swing motion of the stick, the operational point in the swing motion can be accurately attained with relatively simple signal processing. Therefore, it becomes possible to establish precise synchronization between the swing motion of the stick and the display initiation timing in the display control.

The function of the digital processing portion 26 may be easily realized by a microprocessor (corresponding to microprocessor 15 in FIG. 4) to perform the display control.

Another embodiment of the aerial display system according to the present invention, in which a swing mode is discriminated to automatically change images to be displayed, will be discussed here.

Initially, discussion will be given for variation of the swing modes and manner of discrimination thereof. In the discussion given hereabove, the stick 1 is generally oriented in an upright fashion, gripping the grip 4, and swung in a left and right direction, as shown in FIG. 1. In the shown embodiment, this mode of swing motion is referred to as "upward swing mode". In the case of the system employing the acceleration sensor 20 as discussed with respect to FIGS. 8 and 9, the sensor output (F) of the acceleration sensor 20 in the upward swing mode becomes substantially symmetric across a zero reference level, as shown in FIG. 10. The duty cycle of the polarity indicative signal (h) derived with respect to such sensor output (F) is in a range of 35 to 60%.

Figure 11:
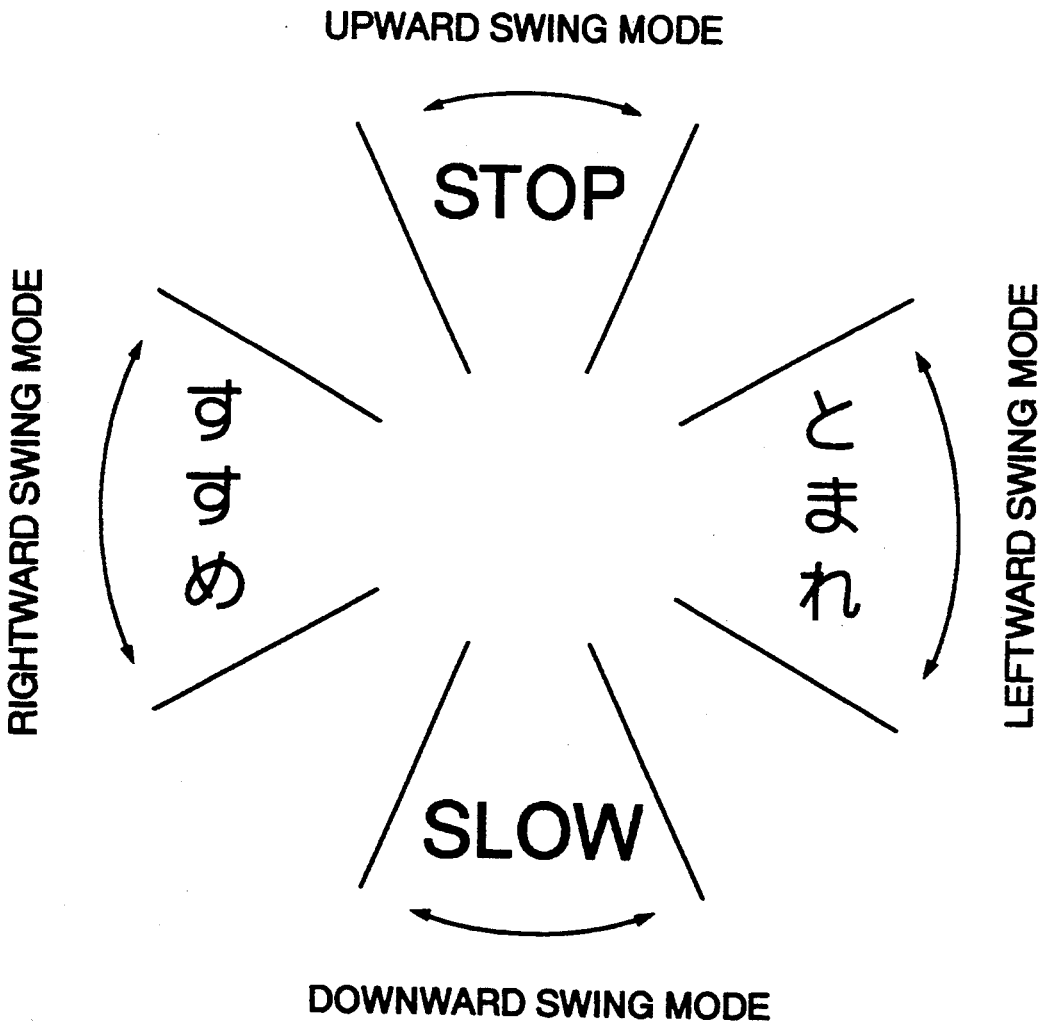
FIG. 11 is an explanatory illustration showing an example of display messages depending upon direction or orientation of the motion of a light emitting array.
Figure 12:
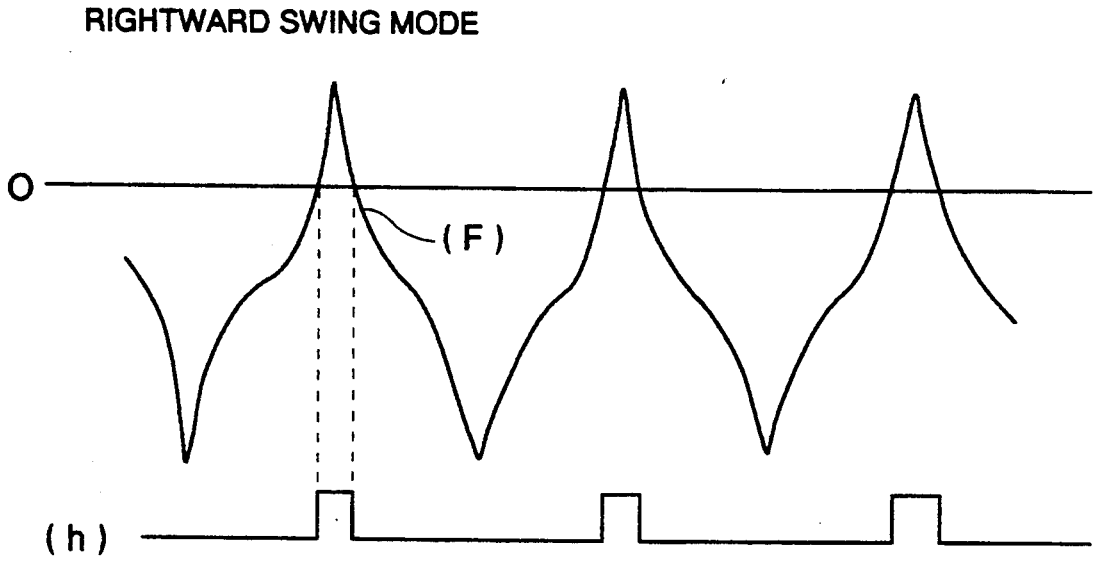
Figure 12:
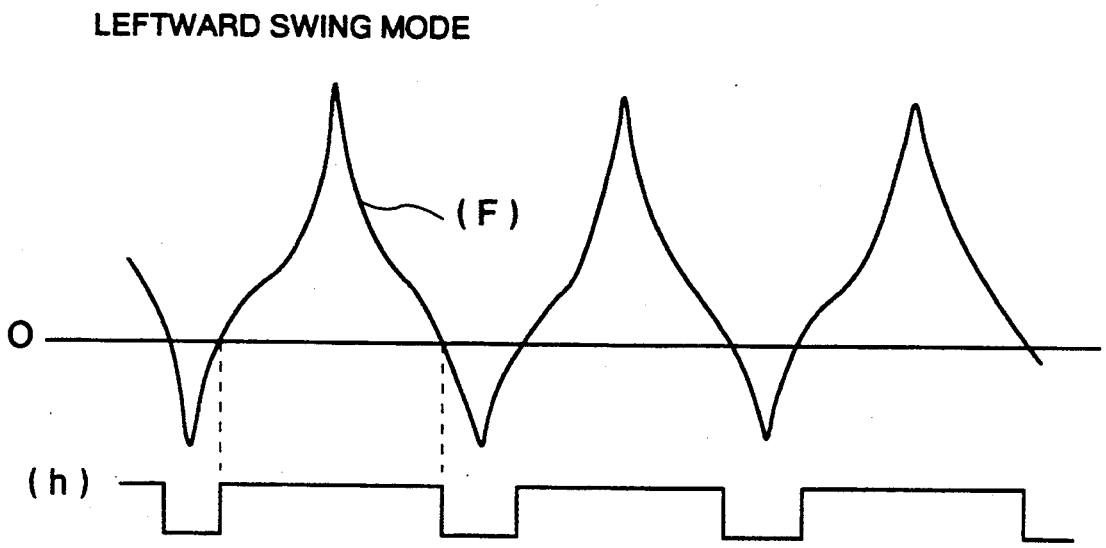

The stick 1 may be oriented horizontally toward the right and swung vertically at the right side of the operator, as shown in FIG. 11. This swing mode is hereafter referred to as "rightward swing mode". In the rightward swing mode, gravitative acceleration in the swing direction is superimposed on the output (F) of the acceleration sensor 20. In such case, as shown in FIG. 12(A), the waveform of the acceleration sensor output (F) is shifted downward relative to the zero reference line. Accordingly, the duty cycle of the polarity detection signal (h) derived with respect to such sensor output (F) becomes lower than or equal to 35%.

The stick 1 may be oriented horizontally toward the left and swung vertically at the left side of the operator, as shown in FIG. 11. This swing mode is hereafter referred to as "leftward swing mode". In the leftward swing mode, the gravitative acceleration in the swing direction is superimposed on the output (F) of the acceleration sensor 20. In such a case, as shown in FIG. 12(B), the waveform of the acceleration sensor output (F) is shifted upward relative to the zero reference line. Accordingly, the duty cycle of the polarity detection signal (h) derived with respect to such sensor output (F) becomes greater than or equal to 60%.

As can be appreciated, the upward swing mode, the rightward swing mode and the leftward swing mode can be easily discriminated on the basis of the duty cycle of the polarity indicative signal (h) derived with respect to the output (F) of the acceleration sensor 20. In order to switch the image to be displayed in the aerial display system illustrated in FIG. 4, a plurality of sets of display data corresponding to the desired images in respective swing modes may be stored in the memory 9. Upon reading out of the display data, the leading address of one of the display data corresponding to the discriminated swing mode is set in the leading address register 14. By this arrangement, the operation to be performed by the microprocessor 15 can be simplified.

It should be noted that even when the motion sensor assembly S illustrated in FIGS. 2, 3 and 4, which includes the slider 7 and the position sensor 8, is used, the motion characteristics of the slider 7 may markedly vary between respective swing modes due to influence of gravitative acceleration. Therefore, the duty cycle of the output (c) of the position sensor shown in FIG. 5 is clearly distinguished in respective swing modes. Accordingly, the swing modes can be successfully discriminated.

In FIG. 11, an additional swing mode, in which the stick 1 is oriented in an upside down fashion and swung in a left and right direction. This mode will be referred to as "downward swing mode". To discriminate between the upward swing mode and the downward swing mode, it is preferable to employ another sensor which is adapted to discriminate upright and upside down orientations of the stick 1. For instance, such a sensor may be formed by a pendulum oriented for vertical movement and a position sensor to detect the pendulum position. In case of the system employing the acceleration sensor 20, the upward swing mode and the downward swing mode may be discriminated by asymmetry of the sensor output (F).

It may also be possible to incorporate an audible signal generator, such as an electronic buzzer, in the aerial display system for generating an audible sound during or at the end of outputting of one field of display data (when the line number L reaches Ls+Ld). By such an audible sound, the operator may know if he is swinging the stick 1 in an appropriate swing stroke or not.

Although the foregoing discussion is given for performing aerial display during swing motion in only one direction, it is, of course, possible to also perform aerial display in the swing motion in the other direction. In such case, in order to form the identical image in overlapping manner, the order of reading out the display data may be reversed and the display initiation timing is automatically controlled. For such bi-directional aerial display, the aerial display system according to the present invention is quite useful.

As can be understood from the preceding disclosure, according to the present invention, stable and clear aerially displayed images can be formed without requiring substantial skill in swinging the stick. Furthermore, since the present invention permits variation of the image to be displayed depending upon the swing mode, it should be useful in traffic control or so forth.

Although the invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within the scope encompassed and equivalents thereof with respect to the features set out in the appended claims.

For instance, although the shown embodiment employs LEDs for forming the light emitting cell array, various light emitting elements may be employed in place of LEDs. For example, a combination of a liquid crystal shutter and a back-light arrangement, a combination of PLZT shutter array with a back-light arrangement, fluorescent tubes or so forth may be employed in place of the LED array.

Furthermore, although the foregoing discussion has concentrated on the application of the aerial display system according to the invention to a the hand-held illuminated stick, the system is applicable in wide variety of equipment including manually and machine operated equipment and so forth. In addition, although the shown embodiment illustrates examples for aerially displaying character messages, it is possible to display various visual messages, such as graphic images or so forth.

What is claimed is:

1. A swing type display system comprising:

an elongated hand-held movable body carrying a light emitting cell array including a plurality of light emitting cells arranged in alignment for reciprocally swinging on a desired surface by manual swing motion at an arbitrary speed to scan said light emitting cell array thereon and form a visual image utilizing an effect of residual image;

display data storage means for storing display data in the form of a bit map;

display data reading out control means for reading out display data from said display data storage means in a given order at a given speed, said display data including a plurality of sets of display data for respective light emitting cells associated with an elapsed time factor representative of angular positions of said hand-held movable body;

driver means adapted to said light emitting cell array, for receiving given bits of said display data read out by said display data reading out control means and for driving each of said light emitting cell arrays ON and OFF;

swing detecting means for producing a detection signal on the basis of the acceleration of the swinging motion of said movable body, said swing detecting means including, an acceleration sensor for generating an output corresponding to the acceleration of the swinging motion of said movable body, and signal processing means for detecting a specific operational point in said swinging motion of said movable body by processing the output from said acceleration sensor, and timing control means responsive to said detection signal for deriving a trigger signal so as to control said display data reading control means such that respective sets of display data for respective light emitting cells are read out at the substantially same angular positions of said hand-held movable body for arbitrary swing speeds.

2. A swing type display system as set forth in claim 1, wherein said signal processing means of said swing detecting means detects a maximum peak and a minimum peak of said output waveform of said acceleration sensor.

3. A swing type display system as set forth in claim 1, wherein said signal processing means of said swing detecting means detects a zero-crossing of said output waveform of said acceleration sensor.

4. A swing type display system as set forth in claim 1, which further comprises a swing period detecting means for detecting a repeating period of the swinging motion on the basis of the output of said acceleration sensor.

5. A swing type display system as set forth in claim 1, which further comprises a swing speed detecting means for detecting an instantaneous swing speed at a desired point in the swinging motion on the basis of said output of said acceleration sensor.

6. A swing type display system as set forth in claim 1, which further comprises a swing mode discrimination means for discriminating a current swing mode out of a plurality of preliminarily set swing modes which are set relative to gravitative direction on the basis of symmetry and asymmetry of the output waveform of said acceleration sensor relative to an amplitude reference line.

7. A swing type display system comprising:

an elongated hand-held movable body carrying a light emitting cell array including a plurality of light emitting cells arranged in alignment for reciprocally swinging on a desired surface by manual swing motion at an arbitrary speed to scan said light emitting cell array thereon and form a visual image utilizing an effect of residual image;

display data storage means for storing display data in the form of a bit map;

display data reading out control means for reading out display data from said display data storage means in a given order at a given speed, said display data including a plurality of sets of display data for respective light emitting cells associated with an elapsed time factor representative of angular positions of said hand-held movable body;

driver means adapted to said light emitting cell array, for receiving given bits of said display data read out by said display data reading out control means and for driving each of said light emitting cell arrays ON and OFF;

swing detecting means for producing a detection signal on the basis of the acceleration of the swinging motion of said movable body, said swing detecting means including, means for movement which oscillates reciprocally within a predetermined range defined by a .guide mechanism in response to a substantially reciprocal swinging motion of said movable body, and a position sensor for detecting said oscillation passing across a predetermined position set between both ends of said predetermined range in a non-contacting manner, and timing control means responsive to said detection signal for deriving a trigger signal so as to control said display data reading control means such that respective sets of display data for respective light emitting cells are read out at the substantially same angular positions of said hand-held movable body for arbitrary swing speeds.

8. A swing type display system as set forth in claim 7, which further comprises a swing period detecting means for detecting the repeating period of the swinging motion on the basis of the output of said position sensor.

9. A swing type display system as set forth in claim 7, which further comprises a swing speed detecting means for detecting the instantaneous speed of said movement at a detecting point on the basis of the output of said position sensor.

10. A swing type display system as set forth in claim 7, which further comprises a swing mode discriminating means for discriminating a current swing mode out of a plurality of preliminarily set swing modes which are set relative to the gravitative direction, on the basis of symmetry and asymmetry of the reciprocal motion of said movement relative to the detecting position of said position sensor by processing the output of said position sensor.

11. A swing type display system as set forth in claim 7, which further comprises a second position sensor for detecting said movement passing across a second detecting point defined with a substantially small interval with said detecting point of said position sensor in said swing detecting means, in a non-contacting manner, and a swing period detecting means for detecting the repeated period of the swinging motion on the basis of the output of said position sensor.

12. A swing type display system as set forth in claim 7, which further comprises a second position sensor for detecting said movement passing across a second detecting point defined with a substantially small interval with said detecting point of said position sensor in said swing detecting means, in a non-contacting manner, and a swing period detecting means for detecting the repeated period of the swinging motion on the basis of a difference in the timings of the detecting signals of said position sensor and said second position sensor.

13. A swing type display system as set forth in claim 7, which further comprises a second position sensor for detecting said movement passing across a second detecting point defined with a substantially small interval with said detecting point of said position sensor in said swing detecting means, in a non-contacting manner, and a swing mode discriminating means for discriminating a current swing mode out of a plurality of preliminarily set swing modes which are set relative to the gravitative direction, on the basis of the symmetry and asymmetry of the reciprocal motion of said movement detected by processing the outputs of said position sensor and said second position sensor.

14. A swing type display system comprising:

an elongated hand-held movable body carrying a light emitting cell array including a plurality of light emitting cells arranged in alignment for reciprocally swinging on a desired surface by manual swing motion at an arbitrary speed to scan said light emitting cell array thereon and form a visual image utilizing an effect of residual image;

display data storage means for storing display data in the form of a bit map;

display data reading out control means for reading out display data from said display data storage means in a given order at a given speed, said display data including a plurality of sets of display data for respective light emitting cells associated with angular position representative time factors of said hand-held movable body;

driver means adapted to said light emitting cell array, for receiving given bits of said display data read out by said display data reading out control means and for driving each of said light emitting cell arrays ON and OFF;

swing detecting means for producing a detection signal on the basis of the acceleration of the swinging motion of said movable body, timing control means responsive to said detection signal for deriving a trigger signal so as to control said display data reading control means such that respective sets of display data for respective light emitting cells are read out at the substantially same angular positions of said hand-held movable body for arbitrary swing speeds; and display initiation timing adjusting means responsive to substantially reciprocal repeated swinging motion of said movable body for controlling said timing control means to adjust a delay period from the occurrence of said detection signal of said swing detecting means to the initiation of the reading out of the display data by said display data reading out control means on the basis of an instantaneous swing speed at a given point in the swinging motion and/or repeating period of the swinging motion.

15. A swing type display system comprising:

an elongated hand-held movable body carrying a light emitting cell array including a plurality of light emitting cells arranged in alignment for reciprocally swinging on a desired surface by manual swing motion at an arbitrary speed to scan said light emitting cell array thereon and form a visual image utilizing an effect of residual image;

display data storage means for storing display data in the form of a bit map;

display data reading out control means for reading out display data from said display data storage means in a given order at a given speed, said display data including a plurality of sets of display data for respective light emitting cells associated with angular position representative time factors of said hand-held movable body;

driver means for receiving given bits of said display data read out by said display data reading out control means, adapted to said light emitting cell array, and for driving each of said light emitting cell arrays ON and OFF;

swing detecting means for producing a detection signal on the basis of the acceleration of the swinging motion of said movable body, timing control means responsive to said detection signal for deriving a trigger signal so as to control said display data reading control means such that respective sets of display data for respective light emitting cells are read out at the substantially same angular positions of said hand-held movable body for arbitrary swing speeds; and data output speed adjusting means responsive to substantially reciprocal repeated swinging motion of said movable body for controlling said timing control means to adjust reading out speed of said display data by said display data reading out control means on the basis of an instantaneous swing speed at a given point in the swinging motion and/or repeating period of the swinging motion.

16. A swing type display system comprising:

an elongated hand-held movable body carrying a light emitting cell array including a plurality of light emitting cells arranged in alignment for reciprocally swinging on a desired surface by manual swing motion at an arbitrary speed to scan said light emitting cell array thereon and form a visual image utilizing an effect of residual image;

display data storage means for storing display data in the form of a bit map;

display data reading out control means for reading out display data from said display data storage means in a given order at a given speed, said display data including a plurality of sets of display data for respective light emitting cells associated with angular position representative time factors of said hand-held movable body;

driver means adapted to said light emitting cell array, for receiving given bits of said display data read out by said display data reading out control means and for driving each of said light emitting cell arrays ON and OFF;

swing detecting means for producing a detection signal on the basis of the acceleration of the swinging motion of said movable body, timing control means responsive to said detection signal for deriving a trigger signal so as to control said display data reading control means such that respective sets of display data for respective light emitting cells are read out at the substantially same angular positions of said hand-held movable body for arbitrary swing speeds;

display initiation timing adjusting means responsive to substantially reciprocal repeated swing motion of said movable body for controlling said timing control means to adjust a delay period from the occurrence of said detection signal of said swing detecting means to the initiation of the reading out of the display data by said display data reading out control means on the basis of an instantaneous swing speed at a given point in the swing motion and/or repeating period of the swing motion; and a data output speed adjusting means responsive to substantially reciprocal repeated swinging motion of said movable body for controlling said timing control means to adjust reading out speed of said display data by said display data reading out control means on the basis of an instantaneous swing speed at a given point in the swinging motion and/or repeating period of the swinging motion.

17. A swing type display system comprising:

an elongated hand-held movable body carrying a light emitting cell array including a plurality of light emitting cells arranged in alignment for reciprocally swinging on a desired surface by manual swing motion at an arbitrary speed to scan said light emitting cell array thereon and form a visual image utilizing an effect of residual image;

display data storage means for storing display data in the form of a bit map;

display data reading out control means for reading out display data from said display data storage means in a given order at a given speed, said display data including a plurality of sets of display data for respective light emitting cells associated with angular position representative time factors of said hand-held movable body;

driver means adapted to said light emitting cell array, for receiving given bits of said display data read out by said display data reading out control means and for driving each of said light emitting cell arrays ON and OFF;

swing detecting means for producing a detection signal on the basis of the acceleration of the swinging motion of said movable body, timing control means responsive to said detection signal for deriving a trigger signal so as to control said display data reading control means such that respective sets of display data for respective light emitting cells are read out at the substantially same angular positions of said hand-held movable body for arbitrary swing speeds; and swing mode discrimination means for discriminating a current swing mode out of a plurality of preliminarily set swing modes which are set relative to the gravitative direction; and data selection means for selectively identifying one of a plurality of display data stored in said display data storage means on the basis of the output of said swing mode discrimination means.

18. An aerial display system comprising:

a movable member carrying a light emitting cell array formed with a plurality of individual light emitting cells arranged in an alignment essentially perpendicular to the direction of motion of said movable member, said movable member being adapted to move across a desired aerial display area carrying said light emitting cell array at an arbitrary speed with a potential cycle-to-cycle deviation of motion speed in a substantial magnitude;

data storage means for storing at least one field of image data defining a display image, said at least one field of image data containing display data for each scanning line corresponding to the instantaneous position of said movable member in motion, said image data including a plurality of sets of cell data for respective light emitting cells and respectively forming fractions of said image data to be formed at relative angular positions for unitary forming said display image;

motion detecting means for producing a detection signal on the basis of the motion of said movable member; and control means for receiving said detection signal and deriving a motion associated control parameter on the basis of the cycle-to-cycle deviation of the motion speed of said movable member so as to control each of said light emitting cells such that one or more selected light emitting cells corresponding to said set of cell data of said display data are illuminated at the substantially same relative angular positions of said movable member.

19. An aerial display system as set forth in claim 18, wherein said control means drives said light emitting cell array for illuminating one or more selected light emitting cells at substantially the same time.

20. An aerial display system as set forth in claim 18, wherein said control means detects a stroke range of motion of said movable member in substantially reciprocal motion, and a cycle period of said substantially reciprocal motion over said stroke range on the basis of said detection signal of said motion detecting means, and by an internal clock provided therein, derives a line shifting interval on the basis of said stroke range and said cycle period.

21. An aerial display system as set forth in claim 19, wherein said control means defines a blanking zone, in which no images are displayed, and a displaying zone, in which one field of the display image is displayed, in said stroke range, and derives said line shifting interval for shifting a given number of scanning lines corresponding to one field within said displaying zone.

22. An aerial display system as set forth in claim 21, wherein said control means detects the leading end of said displaying zone by means of said internal clock and triggers said light emitting elements for initiation of the display operation.

23. An aerial display system as set forth in claim 18, wherein said motion detecting means generates said detection signals, the characteristics of which signal vary depending upon behaviors of said movable member in motion and said control means detects a current mode of motion out of a plurality of predetermined motion modes, in which the behaviors of said movable member are mutually distinct from one another, on the basis of the signal characteristics of said detection signal.

24. An aerial display system as set forth in claim 23, wherein said data storage means stores the display data for a plurality of fields, in which the display data for each field is associated with said plurality of motion modes of said movable member, and said control means selects the display data of one field corresponding to the current motion mode.

25. An aerial display system as set forth in claim 18, wherein said motion detecting means generates said detection signals, the characteristics of which signal vary depending upon orientation of said movable member in motion, and said control means detects a current mode of motion out of a plurality of predetermined motion modes, in which the orientations of said movable member are mutually distinct from one another, on the basis of the signal characteristics of said detection signal.

26. An aerial display system as set forth in claim 23, wherein said data storage means stores the display data for a plurality of fields, in which the display data for each field is associated with said plurality of motion modes of said movable member, and said control means selects the display data of one field corresponding to the current motion mode.

27. An aerial display system as set forth in claim 18, wherein said motion detecting means comprises means for movement oscillating in response to the acceleration of motion of said movable member over a given stroke, and a detector for detecting said movement in oscillation.

28. An aerial display system as set forth in claim 27, wherein the position of said detector is so selected as to detect the movement in oscillation between both terminating ends of said given stroke.

29. An aerial display system as set forth in claim 28, wherein said position of said detector is selected to detect the movement in oscillation at a position corresponding to a substantially intermediate position of said movable member in the stroke range.

30. An aerial display system as set forth in claim 29, wherein said control means defines a displaying zone centered at said intermediate position of motion, in which one field of the display image is displayed, and blanking zones, in which no images are displayed and in said stroke range, derives said line shifting interval for shifting a given number of scanning lines corresponding to one field within said displaying zone.

31. An aerial display system as set forth in claim 28, wherein the path of said movement is defined in the oblique relative to an axis along which said light emitting cells of said light emitting cell array are aligned, so as to differentiate signal characteristics of said detection signal depending upon the orientation of said movable member in motion.

32. An aerial display system as set forth in claim 31, wherein said control means detects a current mode of motion out of a plurality of predetermined motion modes, in which the orientations of said movable member are mutually distinct to one another, on the basis of the signal characteristics of said detection signal.

33. An aerial display system as set forth in claim 32, wherein said movement is supported by a guide member rigidly fixed on said movable member so that said movement may oppose said detector at a given clearance therebetween.

34. An aerial display system as set forth in claim 18, wherein said motion detecting means comprises an acceleration sensor producing said detection signal variable depending upon the magnitude of an acceleration induced by motion of said movable member.

35. An aerial display system as set forth in claim 34, wherein said control means detects the peaks of said detection signal to detect said movable member at the substantially intermediate position in said stroke range.

36. An aerial display system as set forth in claim 29, wherein said control means defines a displaying zone centered at said intermediate position of motion , in which one field of the display image is displayed, and blanking zones, in which no images are displayed and in said stroke range, derives said line shifting interval for shifting given a number of scanning lines corresponding to one field within said displaying zone.

37. A swing type display system comprising:

an elongated hand-held movable body carrying a light emitting cell array including a plurality of light emitting cells arranged in alignment for reciprocally swinging on a desired surface by manual swing motion at an arbitrary speed to scan said light emitting cell array thereon and form a visual image utilizing an effect of residual image;

display data storage means for storing display data in the form of a bit map;

display data reading out control means for reading out display data from said display data storage means in a given order at a given speed, said display data including a plurality of sets of display data for respective light emitting cells associated with angular positions of said hand-held movable body;

driver means adapted to said light emitting cell array, for receiving given bits of said display data read out by said display data reading out control means and for driving each of said light emitting cell arrays ON and OFF;

swing detecting means for producing a detection signal on the basis of the acceleration of the swinging motion of said movable body,and timing control means responsive to said detection signal for deriving a trigger signal so as to control said display data reading control means such that respective sets of display data for respective light emitting cells are read out at the substantially same angular positions of said hand-held movable body for arbitrary swing speeds.

* * * * *